US007296871B2

(12) United States Patent
Guan et al.

(10) Patent No.: US 7,296,871 B2
(45) Date of Patent: Nov. 20, 2007

(54) DEVICE AND STRUCTURE ARRANGEMENTS FOR INTEGRATED CIRCUITS AND METHODS FOR ANALYZING THE SAME

(75) Inventors: Yimin Guan, Lexington, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 406 days.

(21) Appl. No.: 11/025,343

(22) Filed: Dec. 29, 2004

(65) Prior Publication Data

US 2006/0139411 A1 Jun. 29, 2006

(51) Int. Cl.
*B41J 2/393* (2006.01)
*B41J 2/05* (2006.01)

(52) U.S. Cl. ..... 347/19; 347/59

(58) Field of Classification Search ..... 347/14, 347/19–20, 56–59, 50; 438/11, 17, 18, 1
See application file for complete search history.

(56) References Cited

U.S. PATENT DOCUMENTS

| | | | | |
|---|---|---|---|---|
| 4,364,010 | A | 12/1982 | Watari et al. | 324/765 |
| 4,899,180 | A | 2/1990 | Elhatem et al. | 137/319 |
| 4,980,702 | A | 12/1990 | Kneezel | 347/17 |
| 5,049,231 | A | 9/1991 | Shibata | 216/27 |
| 5,164,747 | A | 11/1992 | Osada et al. | 347/19 |
| 5,272,491 | A | 12/1993 | Asakawa et al. | 347/18 |
| 5,641,714 | A * | 6/1997 | Yamanaka | 438/14 |
| 5,774,150 | A * | 6/1998 | Kobayashi et al. | 347/63 |
| 5,815,179 | A | 9/1998 | Silverbrook | 347/59 |
| 5,870,120 | A | 2/1999 | Terai | 347/56 |
| 5,871,656 | A | 2/1999 | Silverbrook | 216/27 |
| 5,962,867 | A | 10/1999 | Liu | 257/48 |
| 6,057,171 | A | 5/2000 | Chou et al. | 438/15 |
| 6,060,895 | A | 5/2000 | Soh et al. | 324/160 |
| 6,076,914 | A | 6/2000 | Imai | 408/92 |
| 6,136,212 | A | 10/2000 | Mastrangelo et al. | 216/49 |
| 6,170,936 | B1 | 1/2001 | Ahne et al. | 347/57 |
| 6,248,604 | B1 | 6/2001 | Eng et al. | 438/21 |
| 6,291,254 | B1 | 9/2001 | Chou et al. | 438/18 |
| 6,312,963 | B1 | 11/2001 | Chou et al. | 438/18 |
| 6,371,589 | B1 | 4/2002 | Conta et al. | 347/14 |
| 6,382,758 | B1 | 5/2002 | Chausanski et al. | 347/17 |
| 6,389,366 | B1 | 5/2002 | Heavlin | 702/84 |
| 6,396,076 | B1 | 5/2002 | Tom | 257/48 |
| 6,423,558 | B1 | 7/2002 | Maeda et al. | 438/17 |
| 6,481,073 | B1 | 11/2002 | Sugahara | 29/25.35 |
| 6,492,189 | B1 | 12/2002 | Yamaguchi | 438/18 |
| 6,524,873 | B1 | 2/2003 | Satya et al. | 438/14 |
| 6,528,984 | B2 | 3/2003 | Beaman et al. | 324/158.1 |
| 6,582,062 | B1 | 6/2003 | Childers et al. | 347/59 |
| 6,599,761 | B2 | 7/2003 | Hess et al. | 438/11 |
| 6,623,995 | B1 | 9/2003 | Chen et al. | 438/14 |
| 6,688,720 | B2 | 2/2004 | Imanaka et al. | 347/19 |
| 6,732,414 | B2 | 5/2004 | Kitahara | 29/25.35 |
| 6,760,053 | B2 | 7/2004 | Rother | 347/191 |
| 6,764,866 | B1 | 7/2004 | Lin et al. | 438/11 |
| 6,767,473 | B2 | 7/2004 | Fujita et al. | 216/27 |

* cited by examiner

*Primary Examiner*—Juanita D. Stephens
(74) *Attorney, Agent, or Firm*—M.Best & Friedrich, LLP

(57) ABSTRACT

An integrated circuit having a plurality of devices. The plurality of devices have a plurality of device characteristics. A sectional cut through the integrated circuit reveals the plurality of device characteristics.

20 Claims, 13 Drawing Sheets
(12 of 13 Drawing Sheet(s) Filed in Color)

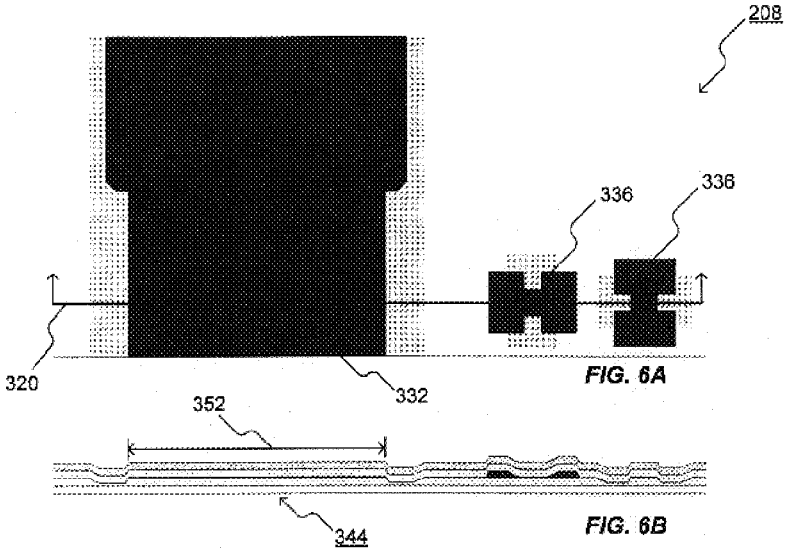
FIG. 6A
FIG. 6B
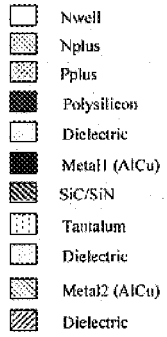
FIG. 6C

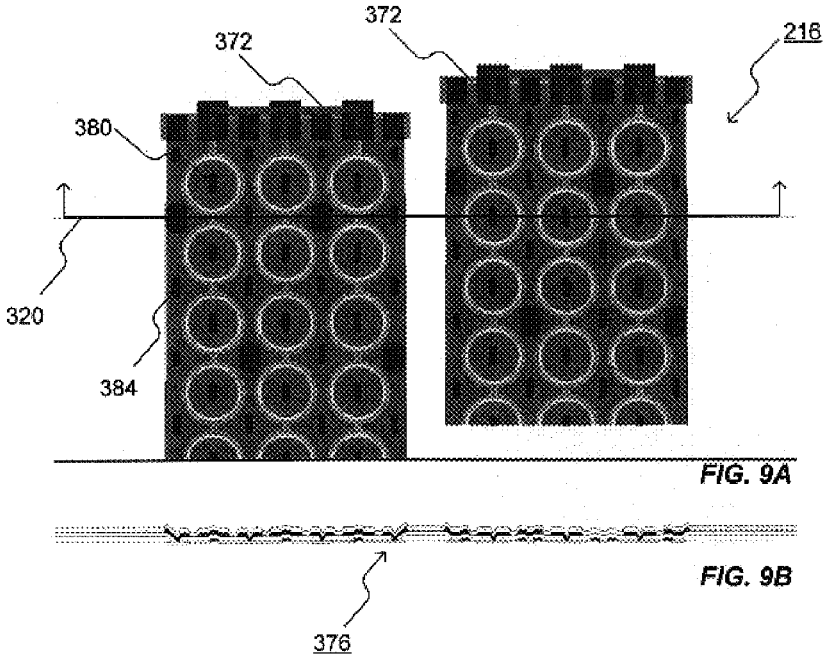
FIG. 9A
FIG. 9B
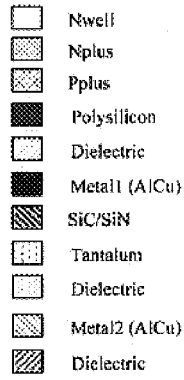
FIG. 9C

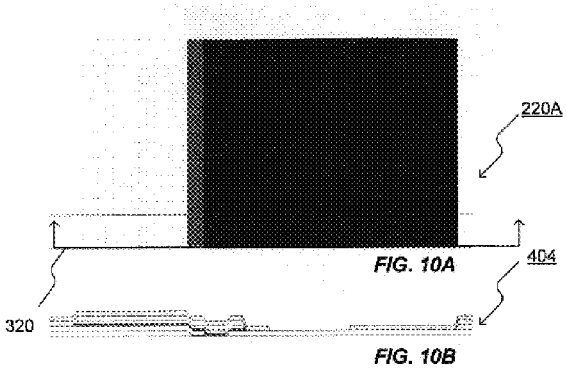
FIG. 10A
FIG. 10B
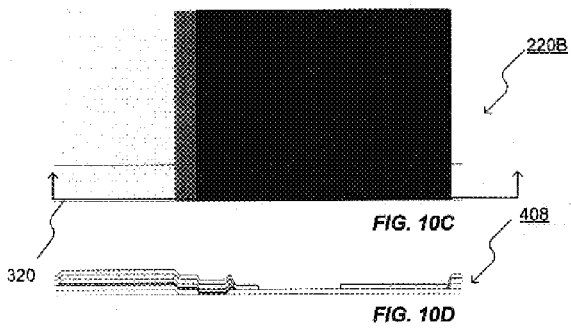
FIG. 10C
FIG. 10D
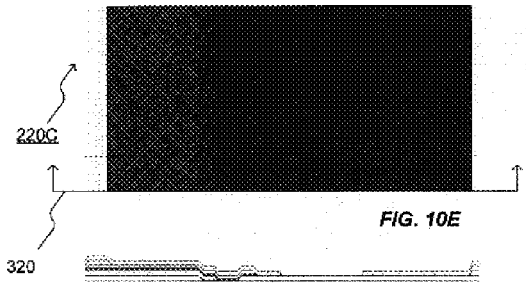
FIG. 10E
FIG. 10F
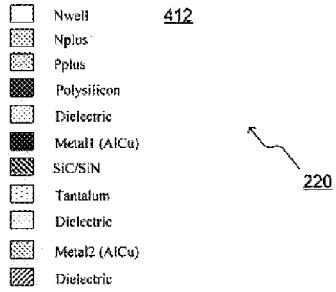
FIG. 10G

DEVICE AND STRUCTURE ARRANGEMENTS FOR INTEGRATED CIRCUITS AND METHODS FOR ANALYZING THE SAME

BACKGROUND

1. Field of the Invention

The invention relates to integrated circuits, and, in one embodiment, particularly to analyses of inkjet print head heater chips.

2. Description of the Related Art

Inkjet printing devices such as inkjet printers, all-in-one devices, multifunction devices, and the like, typically uses a print controller or a printer host to control and to communicate with an inkjet print head. A thermal inkjet print head generally has a heater chip. The heater chip typically includes logic circuitry, a plurality of power transistors, and a set of heaters or resistors, among other things. A hardware or software printer driver will selectively address or energize the logic circuitry such that appropriate resistors are heated for printing. In some heater chip designs, the heater chip includes memory used to store information about the print head. Data stored in the memory is used to identify the print head to determine if the print head is a monochrome print head, a color print head or a photograph quality print head. Data stored in the memory is used to keep track of ink usage.

To monitor and to characterize the functionality of the heater chip, a variety of analytical or monitoring methods, and electrical and material analyses are used to analyze the materials layered in the heater chip and the semiconductor devices of the heater chip. For example, an electrical method is performed by electrically measuring structures that help monitor critical process parameters on every wafer. The electrically measured results of die process monitor ("DPM") structures on the wafer are compared against a predetermined specification. Examples of electrically characterized parameters include sheet resistance, effective line width, and the like. While an electrical method provides a fast indication of process variation and problems, the electrical method does not generally provide a complete characterization. For example, an electrical monitoring method can generally indicate problems, but rarely can determine a root cause of the problem.

On the other hand, material methods are performed using different metrologies in terms of dimension, composition, topology, and the like. For example, material methods such as sectional analysis or cross-section analysis are used to characterize a print head chip. Using sectional analysis, heater chip characteristics such as devices or film features, information on critical dimension, composition profiles, topology as well as material interaction can be collected. Once the information has been collected, other analyses such as process control and failure analysis can use the information to assist in manufacturing processes. For the printhead heater chip, the heater chip analysis becomes even more important since heater chip characteristics such as the film stack thickness needs to be precisely controlled in order to achieve required thermal performance.

Section analysis is performed by grinding and polishing a thin film stack at a location of interest at the heater chip, followed by optical and e-beam inspection. Section analysis is usually very tedious and time consuming. For example, many sectional cuts are necessary to complete a thorough analysis and inspection.

SUMMARY OF THE INVENTION

Accordingly, there is a need for improved heater chip structure to allow for efficient sectional analysis. In one form, the invention provides an integrated circuit that includes, among other things, a plurality of devices having a plurality of device characteristics. The plurality of devices are arranged such that a sectional cut through the integrated circuit reveals the plurality of characteristics of the plurality of devices and structures. In another form, the invention provides an integrated circuit including means for characterizing the integrated circuit wherein a sectional cut through the integrated circuit reveals means for characterizing the integrated circuit.

In yet another form, the invention provides a method of structuring devices in an integrated circuit that has a plurality of locations. The method includes the acts of arranging a plurality of devices of the integrated circuit in close proximity in one of the locations. The method also includes revealing completely the plurality of devices with a section cut on the integrated circuit at the one of the locations.

In yet another form, the invention provides an integrated circuit that has a plurality of locations. The integrated circuit includes a plurality of devices that are arranged in one of the locations. The plurality of devices span an area of no greater than $0.5\times10^{-6}m^2$. Arranging the devices in one location allows a sectional cut to completely reveal a plurality of characteristics of the plurality of devices.

In yet another form, the invention provides an integrated circuit having a die area and a plurality of locations. The integrated circuit includes a plurality of devices that are arranged in one of the locations. The plurality of devices span an area of no greater than 1 percent of the die area. Arranging the devices in one location allows one sectional cut to completely reveal a plurality of characteristics of the plurality of devices.

In yet another form, the invention provides a print head comprising a plurality of devices. The print head has a plurality of locations. One of the locations is configured to allow a sectional cut that completely reveals a plurality of characteristics of the plurality of devices and structures.

Other features and advantages of the invention will become apparent to those skilled in the art upon review of the following detailed description, claims, and drawings.

BRIEF DESCRIPTION OF THE DRAWINGS

The patent or application file contains at least one drawing executed in color. Copies of the patent or patent application publication with color drawings(s) will be provided by the Office upon request and payment of the necessary fee.

FIG. 6A shows a detailed top view of a second portion of the second group of structures.

FIG. 6B shows a detailed sectional view of the second portion of the second group of structures of FIG. 6A.

FIG. 6C illustrates a legend used in FIG. 6A and FIG. 6B.

FIG. 9A shows a detailed top view of a fourth group of structures.

FIG. 9B shows a detailed sectional view of the fourth group of structures of FIG. 9A.

FIG. 9C illustrates a legend used in FIG. 9A and FIG. 9B.

FIG. 10A shows a detailed top view of a first portion of a fifth group of structures.

FIG. 10B shows a detailed sectional view of the first portion of the fifth group of structures of FIG. 10A.

FIG. 10C shows a detailed top view of a second portion of the fifth group of structures.

FIG. 10D shows a detailed sectional view of the second portion of the fifth group of structures of FIG. 10C.

FIG. 10E shows a detailed top view of a third portion of a fifth group of structures.

FIG. 10F shows a detailed sectional view of the third portion of the fifth group of structures of FIG. 10E.

FIG. 10G illustrates a legend used in FIG. 10A, FIG. 10B, FIG. 10C, FIG. 10D, FIG. 10E, and FIG. 10F.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. In addition, the terms "connected" and "coupled" and variations thereof are not restricted to physical or mechanical connections or couplings.

Figure 1:
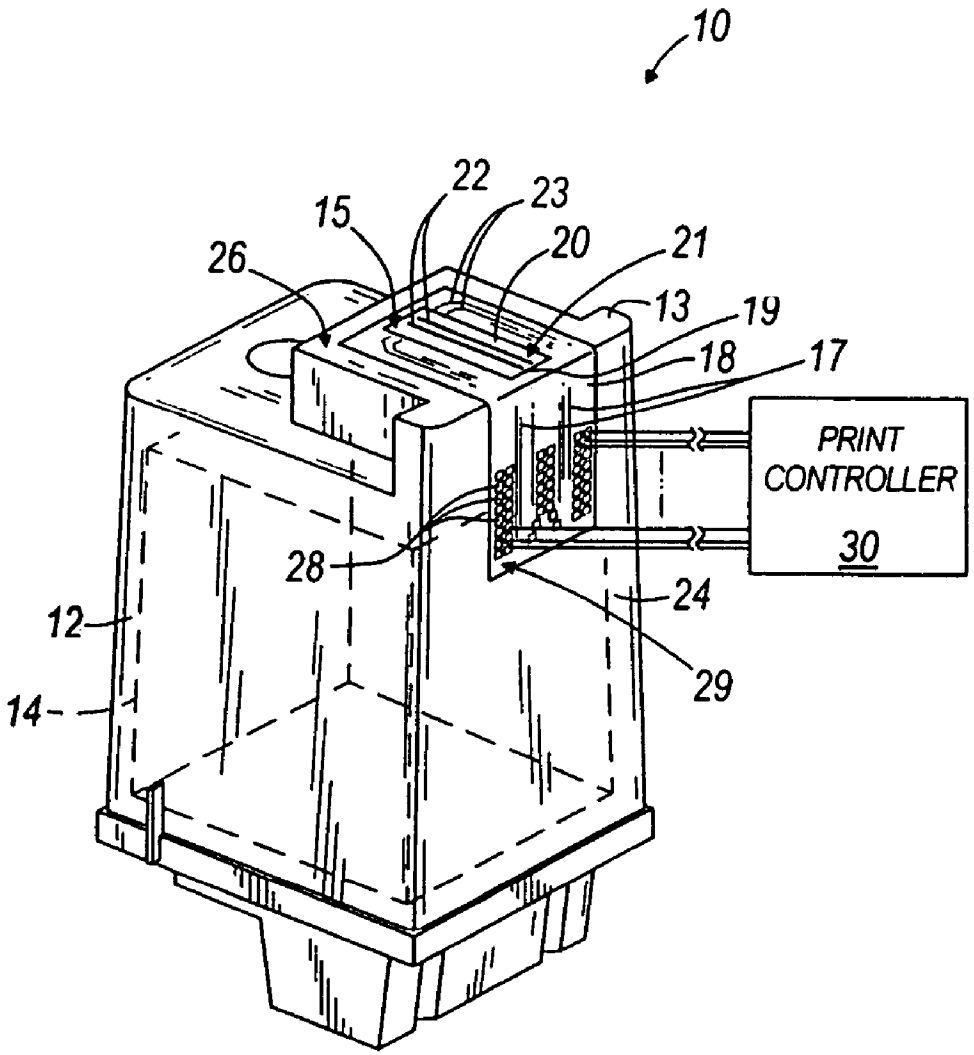
FIG. 1 illustrates an inkjet print head.

FIG. 1 illustrates an inkjet print head 10 according to one embodiment of the invention. The print head 10 includes a housing 12 that defines a nosepiece 13 and an ink reservoir 14 containing ink or a foam insert saturated with ink. The housing 12 can be constructed of a variety of materials including, without limitation, one or a combination of polymers, metals, ceramics, composites, and the like. The inkjet print head 10 illustrated in FIG. 1 has been inverted to illustrate a nozzle portion 15 of the print head 10. The nozzle portion 15 is located at least partially on a bottom surface 26 of the nosepiece 13 for transferring ink from the ink reservoir 14 onto a print medium (not shown). The nozzle portion 15 can include a heater chip 16 (not visible in FIG. 1) and a nozzle plate 20 having a plurality of nozzles 22 that define a nozzle arrangement and from which ink drops are ejected onto printing media that is advanced through a printer (not shown). The nozzles 22 can have any cross-sectional shape desired including, without limitation, circular, elliptical, square, rectangular, and any other shape that allows ink to be transferred from the print head 10 to a printing medium. The heater chip 16 can be formed of a variety of materials including, without limitation, various forms of doped or non-doped silicon, doped or non-doped germanium, or any other semiconducting material. The heater chip 16 is positioned to be in electrical communication with conductive traces 17 provided on an underside of a tape member 18.

The heater chip 16 is hidden from view in the assembled print head 10 illustrated in FIG. 1. The heater chip 16 is also attached to the nozzle plate 20 in a removed area or cutout portion 19 of the tape member 18. The heater chip 16 is attached such that an outwardly facing surface 21 of the nozzle plate 20 is generally flush with and parallel to an outer surface 29 of the tape member 18 for directing ink onto a printing medium via the plurality of nozzles 22 in fluid communication with the ink reservoir 14. Although a thermal inkjet printing apparatus is used in the example, other types of inkjet technology such as piezoelectric technology can also be used with the invention.

Sectional analysis is important for integrated circuits such as the heater chip 16. In some embodiments, a sectional analysis includes making a single sectional cut through the integrated circuits such as the heater chip 16. The sectional cut includes a cut through integrated circuits and semiconductor devices at one or more angles to a vertical axis. In some embodiments, a sectional cut includes a cross-sectional cut made at a right angle to the vertical axis of the chip 16.

As described previously, using a sectional cut through device or film features, information on critical dimensions, composition profiles, topology, as well as material interaction can be collected. As a result, information that characterizes the integrated circuit, semiconductor device including thickness of the film stack can be precisely controlled in order to achieve a required thermal performance. In some embodiments, the film stack can include a heater layer, a passivation film, and a cavitation film. In addition, the integrated circuit or the heater chip 16 can have other characteristics that can also be revealed with a small number of sectional cuts made through the circuit or the chip 16. By making a sectional cut through the location, desired characteristics of the integrated circuit or the heater chip 16 can be completely revealed. If other characteristics of the integrated circuit or the heater chip 16 are desired, other sectional cuts can also be made. In at least one embodiment of the invention, the total amount of sectional cuts is substantially less than an amount of the characteristics revealed thereby.

For the print head chip 16, devices or structures whose measurements or information can characterize the print head chip can include, without limitation, a scribe step without second metal layer, and a scribe step with a second metal layer. Both of these measurements check an edge seal of the chip 16. Other measurements include N implant depth, and P implant depth which measures n-diffusion and p-diff-usion respectively. Measurements such as lightly-doped drain ("LDD") implant depth, N-doped well ("NWELL") implant depth, and LDD space checks a diffusion region depth, NWELL diff-usion region depth, and LDD diff-usion region space can also be made.

Other measurements that can also characterize the chip 16 include first-metal-layer-implant-contact-width, contact-to-polycrystalline Silicon space on active, polycrystalline Silicon line-width on gate oxide, and polycrystalline Silicon space on gate oxide. For example, the first-metal-layer-implant-contact width provides a contact size. The contact-to-polycrystalline Silicon space on active measurements checks a space between the contacts and the polycrystalline Silicon. The polycrystalline Silicon line-width on gate oxide measurement, and the polycrystalline Silicon space on gate-oxide measurement check the polycrystalline Silicon gate width and space at an active region, respectively. The polycrystalline Silicon line-width-in-field-oxide measurement, and the polycrystalline Silicon space-on-field-oxide measurement check a polycrystalline Silicon gate width and space on top of a field oxide, respectively. The polycrystalline Silicon metal contact checks the polycrystalline Silicon metal contact size.

Still other measurements include first-metal-layer-line width, first-metal-layer-to-first-metal-layer space, and first-metal-layer-to-second-metal-layer via that check a first metal layer line width, a distance between the first metal layer lines, and a via size between the first metal layer and the second metal layer, respectively. Other measurements can include second-metal-layer line width that checks a second metal layer line width, and second-metal-layer-to-second-metal-layer space that checks a second metal spacing, respectively. Another measurement includes second-metal-layer-to-first-metal-layer-to-polycrystalline Silicon overlap that checks an overlap between the second metal layer, the first metal layer, and the polycrystalline Silicon, respectively.

Still other measurements include first-metal-layer-with-Tantalum-step-up, and Tantalum-with-spin-on-glass ("SOG") step down. The first-metal-layer-with-Tantalum-step-up measurement provides a coverage of a first-layer-metal-over-edge-of-an-active-region. The Tantalum-with-SOG-step-down measurement provides a SOG step coverage over an active region. Other measurements are heater length with Tantalum and without SOG, and heater width with Tantalum and without SOG, which provide a length and a width of the heater. Similarly, measurements such as heater length without Tantalum and with SOG, and heater width without Tantalum and with SOG which also provide a length and a width of the heater. Fuse length and fuse width, both without Tantalum but with SOG provide fuse resistor length and width without Tantalum but with SOG, respectively. Field effect transistor ("FET") drain contacts and source contacts provide power transistor contact size. FET polycrystalline Silicon line width and first metal layer line width measure a transistor polycrystalline Silicon width and a first metal layer width, respectively. FET P-substrate contact measurement checks a p-substrate contact size of a transistor. FET LDD space measurement checks a transistor LDD space. Ink-via-seal-after-silicon-trenching-fix, ink-via-seal-before-silicon-trenching-fix, and ink-via-seal-without-inter-metal-dielectric ("IMD") measurements check ink via edge seals.

Figure 2:
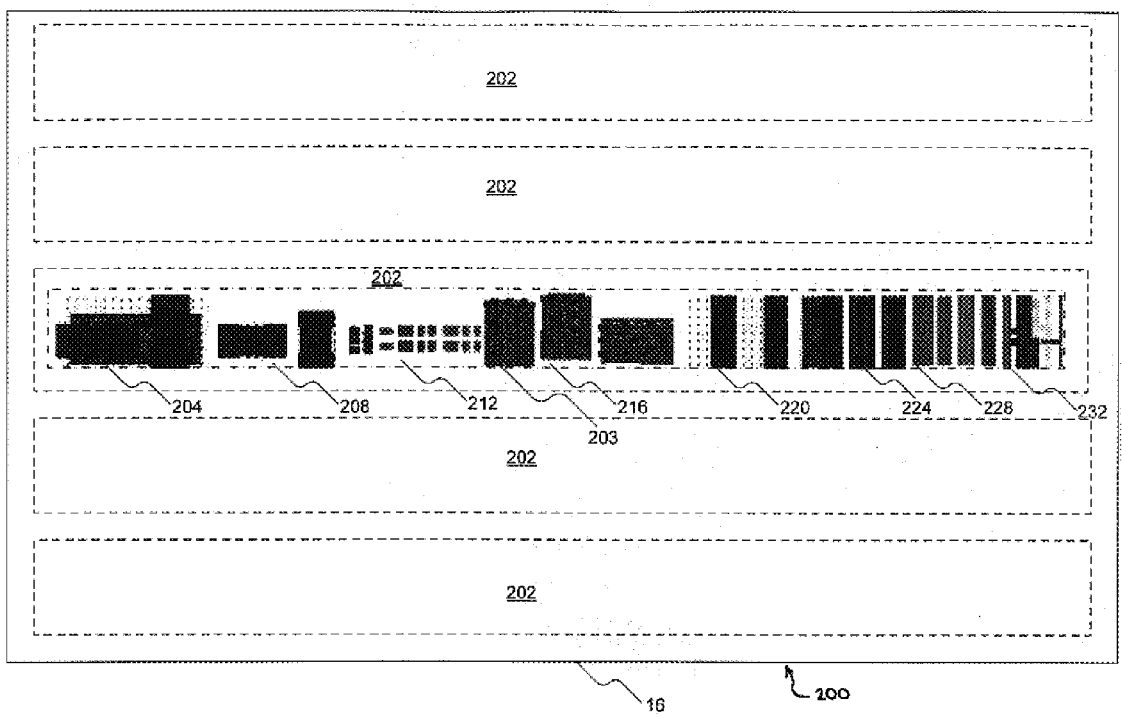
FIG. 2 shows a top view of a one-cut structure.

FIG. 2 shows a top view of an exemplary one-cut structure 200 of the print head chip 16. The exemplary one-cut structure 200 includes a plurality of locations 202. A plurality of devices (discussed below) are arranged in one of the locations 202 or in an array in one of the locations 202 such that a sectional cut through one of the locations 202 can completely reveal a sectional view or the characteristics of the devices or structures. In some embodiments, the devices span an area 203 of no greater than $0.5\times10^{-6}m^2$. In some embodiments, the area 203 is no greater than $0.08\times10^{-6}m^2$. In some embodiments, the area 203 is no greater than 1 percent of the die area. In some embodiments, the area is no greater than 0.15 percent of the die area. In this way, all the features of interest that need to be measured are grouped according to the application or use of the chip, and arranged across the heater chip 16 with one or more orientations, such that collecting the measurements described earlier can be accomplished with a single sectional cut. The one-cut structure 200 as shown in FIG. 2 can then be put on every die on a wafer such that the process at the die level can be monitored and characterized. In addition, the one-cut structure 200 also allows the material structure for any given die or printhead to be diagnosed and analyzed. Of course, the structures can be arranged in other orders depending on the requirements of the application at hand.

Particularly, FIG. 2 shows a first group of structures 204 that includes a heater with Tantalum but without SOG, which has a length and a width that can define a resistance of the heater, detailed hereinafter. FIG. 2 also shows a second group of structures 208 that includes a plurality of heaters and fuses, both without Tantalum but with SOG. The heaters have a length and a width that can define a resistance of the plurality of heaters, detailed hereinafter. A third group of structures 212 includes a plurality of logic transistors with drain contacts, source contacts, and polycrystalline Silicon and metal line. The width of the contacts, polycrystalline Silicon and metal line can characterize the transistors, detailed hereinafter.

FIG. 2 also shows a fourth group of structures 216 that includes a plurality of FET's with a plurality of drain contacts, source contacts, and polycrystalline Silicon and metal line. The width of the contacts, polycrystalline Silicon and metal lines can characterize the FET's. The fourth group of structures 216 also includes a second set of power FET's whose LDD space can characterize the second set of power FET's. A fifth group of structures 220 includes a plurality of ink via, whose steps can characterize the ink via. A sixth group of structures 224 includes a plurality of scribes with and without a second metal layer, whose step up and step down can characterize the scribe. A seventh group of structures 228 includes polycrystalline Silicon on gate oxide or field oxide, whose line width and polycrystalline Silicon to contact space can characterize the heater chip 16, among other things, detailed hereinafter. In some embodiments, the FET's can be power FET's.

FIG. 2 also shows an eighth group of structures 232 that includes a first metal layer, a second metal layer and polycrystalline Silicon. The polycrystalline Silicon to metal contact, first metal layer to second metal layer via, and first layer metal and second metal layer line width can characterize the heater chip 16. Although the structures 204, 208, 212, 216, 220, 224, 228, and 232 are arranged in a specific order, the structures can also be arranged in other orders.

Figure 3A:
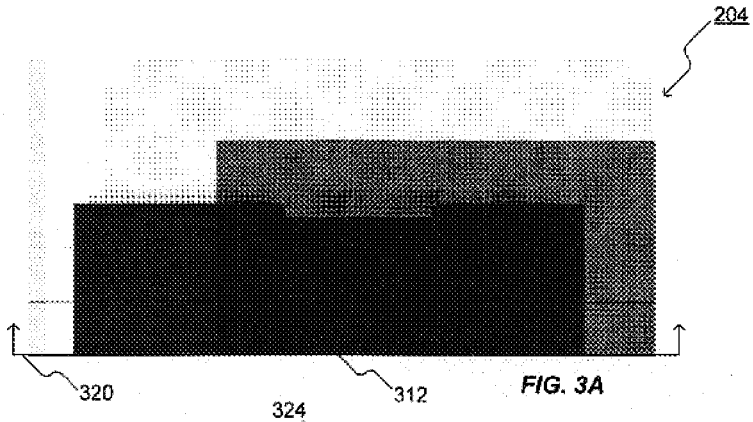
FIG. 3A shows a detailed top view of a first portion of a first group of structures.
Figure 3B:
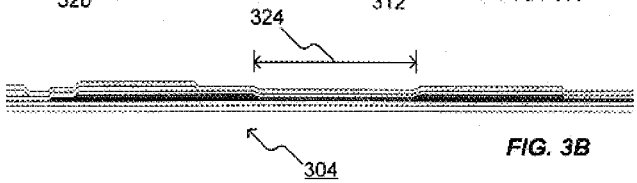
FIG. 3B shows a detailed sectional view of the first portion of the first group of structures of FIG. 3A.
Figure 3C:
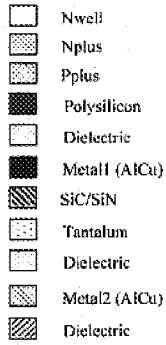
FIG. 3C illustrates a legend used in FIG. 3A and FIG. 3B.
Figure 4A:
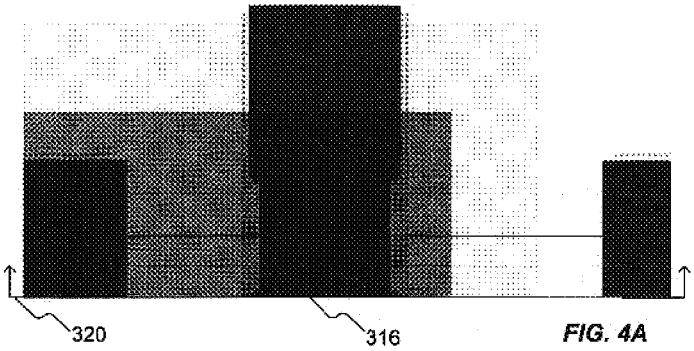
FIG. 4A shows a detailed top view of a second portion of the first group of structures.
Figure 4B:
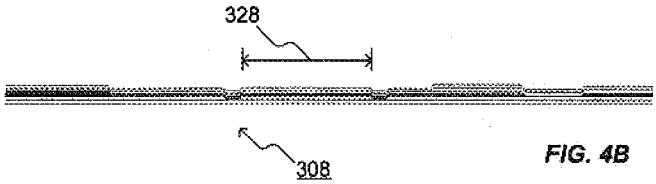
FIG. 4B shows a detailed sectional view of the second portion of the first group of structures of FIG. 4A.
Figure 4C:
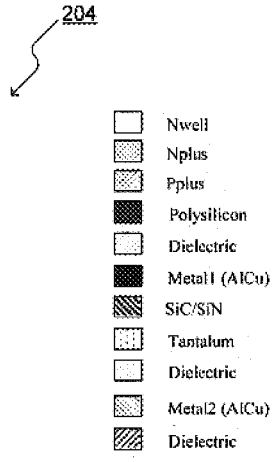
FIG. 4C illustrates a legend used in FIG. 4A and FIG. 4B.

FIG. 3A, FIG. 3B, FIG. 4A, and FIG. 4B show detailed top views of the first group of structures 204, and their corresponding cross sectional views 304, 308 of the first group of structures 204 respectively. FIG. 3C and FIG. 4C list a legend used in FIG. 3A, FIG. 3B, FIG. 4A, and FIG. 4B. The first group of structures 204 includes a first heater 312 and a second heater 316. The first heater 312 is arranged perpendicular to the second heater 316. Both the first and the second heaters 312, 316 are with Tantalum but without SOG. A single cross sectional cut through the first group of structures 204 at line 320 can reveal some characteristics of the heater chip 16. For example, among other things, after the cross sectional cut, a length 324 of the first heater 312 and a width 328 of the second heater 316 together define an area from which a resistance of the area can be determined. In some embodiments, the resistance of the area determines an amount of energy that is supplied to the heaters 312, 316. In some embodiments, other measurements can also be obtained with the single sectional cut. In addition, other types of heaters can also be included in the structure 204. The embodiment merely shows that a single sectional cut can reveal the structures when the structures of interest are arranged on a same plane.

Figure 5A:
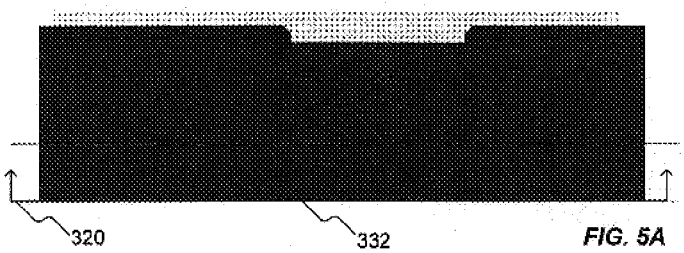
FIG. 5A shows a detailed top view of a first portion of a second group of structures.
Figure 5B:
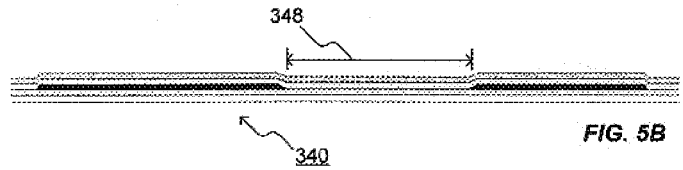
FIG. 5B shows a detailed sectional view of the first portion of the second group of structures of FIG. 5A.
Figure 5C:
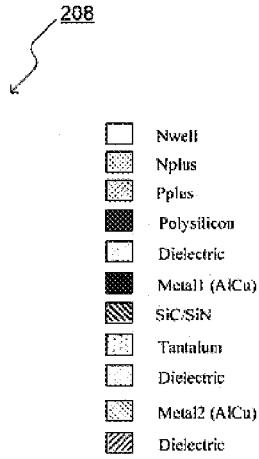
FIG. 5C illustrates a legend used in FIG. 5A and FIG. 5B.

FIG. 5A, FIG. 5B, FIG. 6A, and FIG. 6B show detailed top and sectional views of the second group of structures 208 that includes a plurality of heaters 332 and fuses 336. FIG. 5C and FIG. 6C list a legend used in FIG. 5A, 5B, 6A, and 6B. Both the heaters 332 and the fuses 336 are without Tantalum but with SOG. Two corresponding cross sectional views 340, 344 along line 320 are also shown. The single cross sectional cut through the second group of structures 204 along the line 320 can reveal some characteristics of the heater chip 16. For example, among other things, after the cross sectional cut, a second length 348 of the heater 332 and a width 352 of the heater 336 together define a second area from which a second resistance of the second area can be determined. In some embodiments, the resistance of the second area determines an amount of energy that is supplied to the heaters 332, 336. In some embodiments, other measurements can also be obtained with the single sectional cut. Of course, other types of heaters can also be included in the structure 208.

Figure 7A:
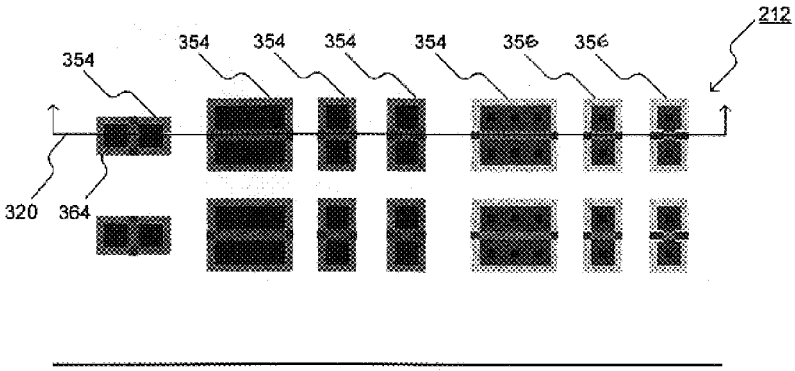
FIG. 7A shows a detailed top view of a first portion of a third group of structures.
Figure 7B:
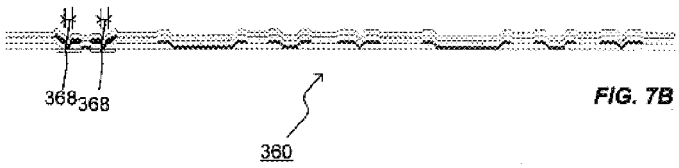
FIG. 7 shows a detailed sectional view of the first portion of the third group of structures of FIG. 7A.
FIG. 7C illustrates a legend used in FIG. 7A and FIG. 7B.
Figure 7C:
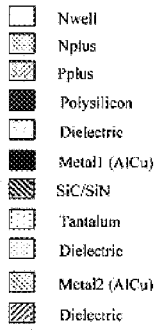
Figures 8A, 8B, 8C:
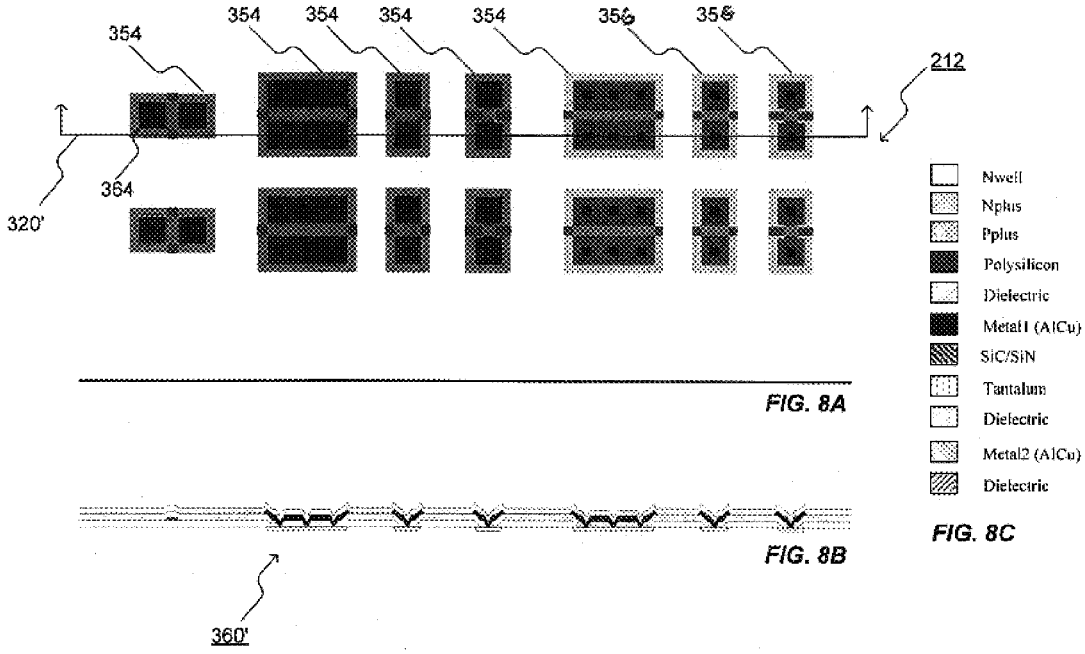
FIG. 8A shows a detailed top view of a second portion of the second group of the third group of structures.
FIG. 8B shows a detailed sectional view of the second portion of the third group of structures of FIG. 8A.
FIG. 8C illustrates a legend used in FIG. 8A and FIG. 8B.

FIGS. 7A, 7B and 7C show detailed top and sectional views and a legend of the third group of structures 212 that includes a plurality of logic transistors 354, 356, and a corresponding cross sectional view 360. The logic transistors 354, 356 have contacts 364 arranged in active regions. The single cross sectional cut through the third group of structures 212 along the line 320 can reveal some characteristics of the logic transistors 354, 356. For example, the contacts 354 have a plurality of contact widths 368 that can be revealed through the single sectional cut along line 320. The logic transistors 354 p-type material, while the logic transistors 356 are of n-type material. In addition, the sectional view 360 can also reveal measurements such as polycrystalline Silicon line width, metal line width, and the like. Of course, other types of logic transistors can also be included in the structure 212. Similarly, FIGS. 8A, 8B, and 8C show additional detailed top and sectional views and a legend, of the third group of structures 212 with a different cut at line 320.

FIGS. 9A, 9B and 9C show detailed top and sectional views, and a legend of the fourth groups of structures 216 that includes a plurality of FET's 372, and a corresponding cross sectional view 376 along line 320. The single cross sectional cut through the third group of structures 216 along the line 320 can reveal some characteristics of the FET's 372 For example, the FET's 372, have drain contacts 380 and source contacts 384 whose width can characterize the FET's 372. In addition, the sectional view 376 can also reveal other measurements such as polycrystalline Silicon line width, metal line width, LDD spacing, and the like. Of course, other types of FET's can also be included in the structure 216. In some embodiments, the FET's 372, can be power transistors.

FIGS. 10A, 10C, and 10E show a plurality of detailed top views of the fifth group of structures 220 that includes a plurality of ink via 220A, 220B, 220C, respectively. FIGS. 10B, 10D and 10F show a plurality of corresponding cross sectional views 404, 408, 412 along the line 320, respectively. FIG. 10G illustrates a legend used in FIGS. 10A-10F. The single cross sectional cut through the fifth group of structures 220A, 220B, 220C along the line 320 can reveal some characteristics of a plurality of step coverages of the ink via 220A, 220B, 220C. For example, when the dielectric layer has to cover what looks like a single stair step, the dielectric layer thickness tends to thin at an edge of the step. A thin dielectric layer at the edge can lead to failure if the dielectric layer is discontinuous anywhere in the step. Of course, other types of ink via can also be included in the structure 220.

Figure 11A:
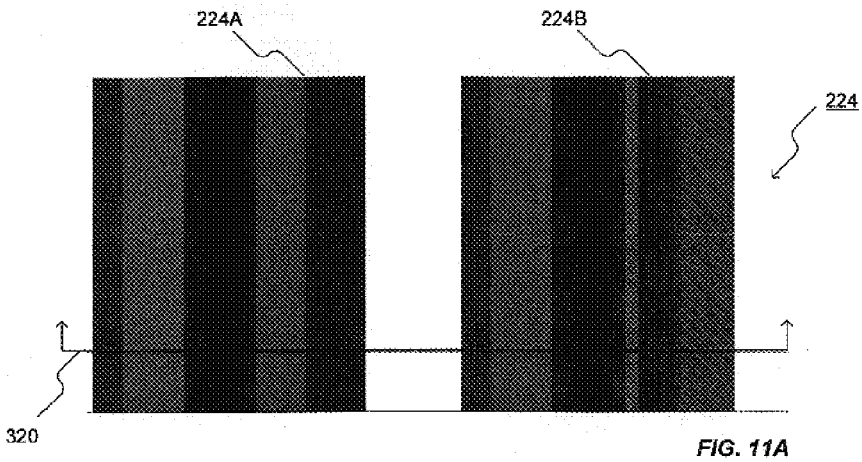
FIG. 11A shows a detailed top view of a sixth group of structures.
Figure 11B:
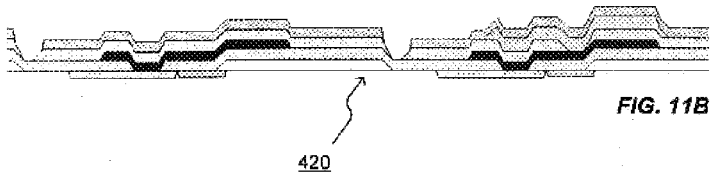
FIG. 11B shows a detailed sectional view of the sixth group of structures of FIG. 11A.
Figure 11C:
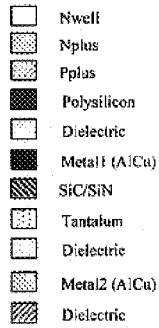
FIG. 11C illustrates a legend used in FIG. 11A and FIG. 11B.

FIGS. 11A, 11B, and 11C show detailed top and sectional views and the corresponding legend of the sixth group of structures 224 that includes a plurality of scribes 224A, 224B. The first scribe 224A is without a second metal layer, whose step coverage can characterize the first scribe 224A, whereas the second scribe 224B is with a second metal lay whose step coverage can also characterize the first scribe 224B. A sectional view 420 cut along the line 320 is also shown in FIG. 11. The single cross sectional cut through the sixth group of structures 224 along the line 320 can reveal some characteristics of the scribes 224A, 224B. For example, the single cross sectional cut through the scribes 224A, 224B can reveal, among other things, edge sealing of the scribes 224A, 224B.

Figures 12A, 12B, 12C:
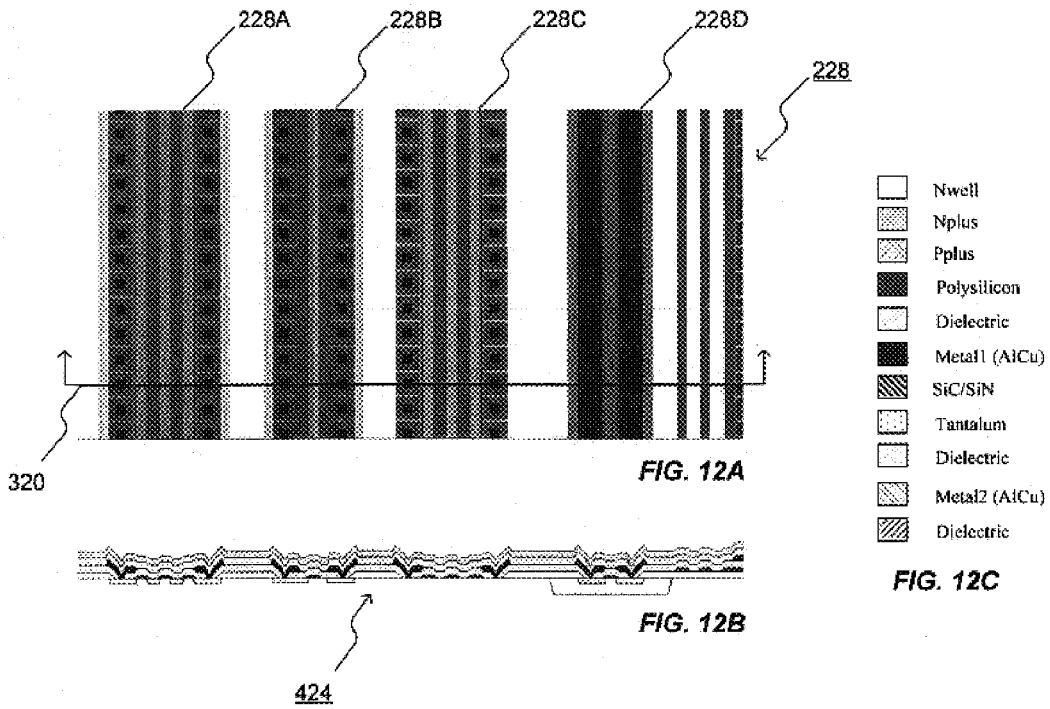
FIG. 12A a detailed top view of a seventh group of structures.
FIG. 12B a detailed top view of a seventh group of structures of FIG. 12A.
FIG. 12C illustrates a legend used in FIG. 12A and FIG. 12B.

FIGS. 12A, 12B, and 12C show detailed top and sectional views and the corresponding legend of the seventh group of structures 228 that includes the polycrystalline Silicon on gate oxide or field oxide, respectively. Particularly, the seventh group of structures 228 includes an n-MOS transistor 228A, an LDD transistor 228B, a gate oxide transistor without implant 228C, and a p-MOS transistor 228D. A sectional view 424 cut along the line 320 is also shown in FIG. 12. The single cross sectional cut through the seventh group of structures 228 along the line 320 can reveal some characteristics of the polycrystalline Silicon on gate oxide or field oxide. For example, the single cross sectional cut can reveal a size of a drain contact, a polycrystalline Silicon line width, a polycrystalline Silicon to contact spacing, channel length of the transistors, doping concentration, and the like.

Figure 13A:
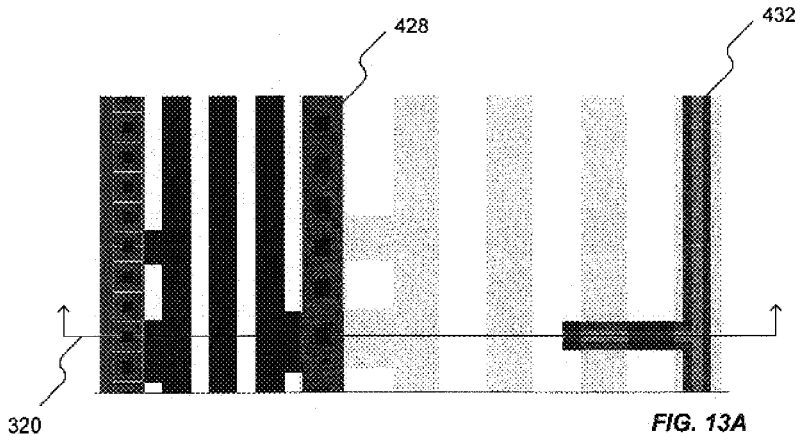
FIG. 13A shows a detailed top view of a eighth group of structures.
Figure 13B:
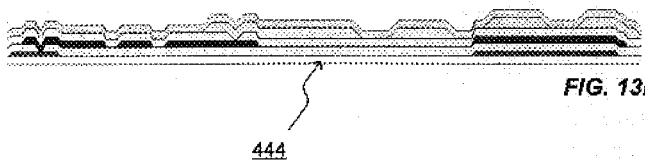
FIG. 13B shows a detailed sectional view of the eighth group of structures.
Figure 13C:
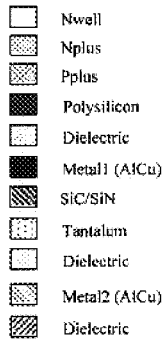
FIG. 13C illustrates a legend used in FIG. 13A and FIG. 13B.

FIGS. 13A, 13B, and 13C show detailed top and sectional views and the corresponding legend, respectively, of the eighth group of structures 232 that includes a plurality of metal layers, metal via, and metal overlaps. For example, FIG. 12 shows a metal via 428 between a first metal layer and a second metal layer, and an overlap 432 of the first metal layer, the second metal layer, and a polycrystalline Silicon layer. A sectional view 444 of the eighth group of structures 232 along the line 320 with a single cross sectional cut is also shown in FIG. 12. The single cross sectional cut through the eighth group of structures 232 along the line 320 can reveal some characteristics of the metal layers, metal via, and metal overlaps. For example, the single cross sectional cut can reveal the metal via 428, polycrystalline Silicon to metal contact, metal to metal line width, metal line width, metal line space, and the like.

Various features and advantages of the invention are set forth in the following claims.

The invention claimed is:

1. An integrated circuit comprising a plurality of devices having a plurality of device characteristics, the plurality of devices are physically aligned such that a sectional cut through the integrated circuit completely reveals the plurality of device characteristics.

2. The integrated circuit of claim 1, further comprising a plurality of structures arranged adjacent the plurality of devices wherein the sectional cut through the integrated circuit completely reveals a plurality of characteristics of the plurality of structures.

3. The integrated circuit of claim 1, wherein the sectional cut comprises a cross sectional cut.

4. A method of structuring devices in an integrated circuit, the integrated circuit having a plurality of locations, the method comprising the acts of:

arranging a plurality of devices of the integrated circuit in close proximity in one of the locations; and revealing the plurality of devices with a sectional cut on the integrated circuit at the one of the locations.

5. An integrated circuit having a plurality of locations, the integrated circuit comprising a plurality of devices in one of the plurality of locations, wherein the one of the plurality of locations has an area of no greater than $0.5\times10^{-6}m^2$, and wherein the one of the locations is configured to allow a sectional cut to completely reveal a plurality of characteristics of the plurality of devices.

6. The integrated circuit of claim 5, wherein the area is at most $0.08\times10^{-6}m^2$.

7. An integrated circuit having a die area and a plurality of locations, the integrated circuit comprising a plurality of devices in one of the plurality of locations, wherein the one of the plurality of locations has an area of no greater than 1 percent of the die area, and wherein the one of the locations is configured to allow a sectional cut to completely reveal a plurality of characteristics of the plurality of devices.

8. The integrated circuit of claim 7, wherein the area is at most 0.15 percent of the die area.

9. An inkjet printing apparatus comprising a print head having a plurality of locations, and a plurality of devices arranged on one of the plurality of locations, wherein the one of the locations is configured to allow a sectional cut that completely reveals a plurality of characteristics of the plurality of devices.

10. A print head comprising a plurality of devices, the print head having a plurality of locations wherein one of the locations is configured to allow a sectional cut that reveals a plurality of characteristics of the plurality of devices and structures.

11. An integrated circuit comprising a plurality of devices, each of the devices having a plurality of characteristics, the devices are physically oriented to allow sectional cuts made through the circuit to reveal the device characteristics, wherein an amount of the sectional cuts needed to reveal the device characteristics is substantially less than an amount of device characteristics revealed.

12. The integrated circuit of claim 11, wherein the plurality of devices comprise at least one of a heater, a fuse with spin-on glass ("SOG"), a plurality of logic transistors, a plurality of power field-effect transistors, a plurality of ink via, and a plurality of scribes.

13. The integrated circuit of claim 12, wherein the plurality of logic transistors are arranged in a plurality of orientations with respect to the sectional cuts and the plurality of power field-effect transistors are arranged in a plurality of orientations with respect to the sectional cuts.

14. The integrated circuit of claim 11, further comprising a plurality of structures arranged adjacent the plurality of devices wherein the sectional cuts through the integrated circuit completely reveals a plurality of characteristics of the plurality of structures, wherein the amount of the sectional cuts is substantially less than an amount of the revealed characteristics of the structures.

15. The integrated circuit of claim 11, wherein the plurality of device characteristics comprise at least one of a heater length, a heater width, a fuse length, a fuse width, a scribe step coverage, a transistor length, a transistor width, a contact size, a polycrystalline Silicon line width, a polycrystalline Silicon line space, an N-implant depth, a P-implant depth, a lightly-doped drain ("LDD") implant depth, a LDD implant space, an NWELL depth, metal to implant contact width, a contact to polycrystalline Silicon space on an active region, a polycrystalline Silicon spacing, a polycrystalline Silicon line width, metal to metal spacing, metal to metal via, a metal line width, and a metal to metal to polycrystalline overlap.

16. The integrated circuit of claim 11, wherein at least one of the sectional cuts comprises a cross-sectional cut.

17. An integrated circuit comprising a plurality of devices having a plurality of device characteristics, the plurality of devices are physically aligned such that a sectional cut through the integrated circuit completely reveals the plurality of device characteristics, wherein the plurality of devices comprises at least one of a heater, a fuse with spin-on glass ("SOG"), a plurality of logic transistors, a plurality of power field-effect transistors, a plurality of ink via, and a plurality of scribes.

18. The integrated circuit of claim 17, wherein the plurality of logic transistors are arranged in a plurality of orientations with respect to the sectional cut.

19. The integrated circuit of claim 17, wherein the plurality of power field-effect transistors are arranged in a plurality of orientations with respect to the sectional cut.

20. The integrated circuit comprising a plurality of devices having a plurality of device characteristics, the plurality of devices are physically aligned such that a sectional cut through the integrated circuit completely reveals the plurality of device characteristics, wherein the plurality of device characteristics comprise at least one of a heater length, a heater width, a fuse length, a fuse width, a scribe step coverage, a transistor length, a transistor width, a contact size, a polycrystalline Silicon line width, a polycrystalline Silicon line space, an N-implant depth, a P-implant depth, a lightly-doped drain ("LDD") implant depth, a LDD implant space, an NWELL depth, metal to implant contact width, a contact to polycrystalline Silicon space on an active region, a polycrystalline Silicon spacing, a polycrystalline Silicon line width, metal to metal spacing, metal to metal via, a metal line width, and a metal to metal to polycrystalline Silicon overlap.

* * * * *